United States Patent [19]

Lavigne

[11] 4,209,046

[45] Jun. 24, 1980

[54] LOG QUARTERING WEDGE

[75] Inventor: Charles O. Lavigne, Ludlow, Mass.

[73] Assignee: Lavigne & Gauthier, Inc., Ludlow, Mass.

[21] Appl. No.: 861,996

[22] Filed: Dec. 19, 1977

Related U.S. Application Data

[63] Continuation-in-part of Ser. No. 805,928, Jun. 13, 1977, abandoned.

[51] Int. Cl.[2] ..... B27L 7/00

[52] U.S. Cl. ..... 144/193 D; 254/104

[58] Field of Search ..... 145/2 R; 254/104; 144/3 K, 193 R, 193 A, 193 B, 193 C, 193 D, 193 F, 193 H, 193 K

[56] References Cited

U.S. PATENT DOCUMENTS

| | | | |
|---|---|---|---|
| 508,221 | 11/1893 | Hill | 144/193 A |
| 905,069 | 11/1908 | Hair | 144/193 D |
| 1,261,834 | 4/1918 | Manning | 254/104 |
| 1,307,714 | 6/1919 | Van Slyke | 144/193 B |
| 3,515,372 | 6/1970 | Courville | 144/193 R |
| 3,974,867 | 8/1976 | Butas, Jr. | 144/193 A |

FOREIGN PATENT DOCUMENTS

| | | | |
|---|---|---|---|
| 233927 | 5/1961 | Australia | 144/193 A |
| 185266 | 4/1956 | Austria | 144/193 D |

*Primary Examiner*—Robert Louis Spruill
*Assistant Examiner*—W. D. Bray
*Attorney, Agent, or Firm*—Chapin, Neal & Dempsey

[57] ABSTRACT

A log quartering wedge comprises a splitting wedge having a pair of opposed converging lateral surfaces meeting at a leading chisel edge and a pair of generally planar quartering blades disposed perpendicular to the leading edge of the wedge. The blades each include a generally straight leading edge defining an acute angle with the adjacent lateral surface of the wedge. The outer tips of the blades are set back longitudinally from the leading edge of the wedge.

6 Claims, 8 Drawing Figures

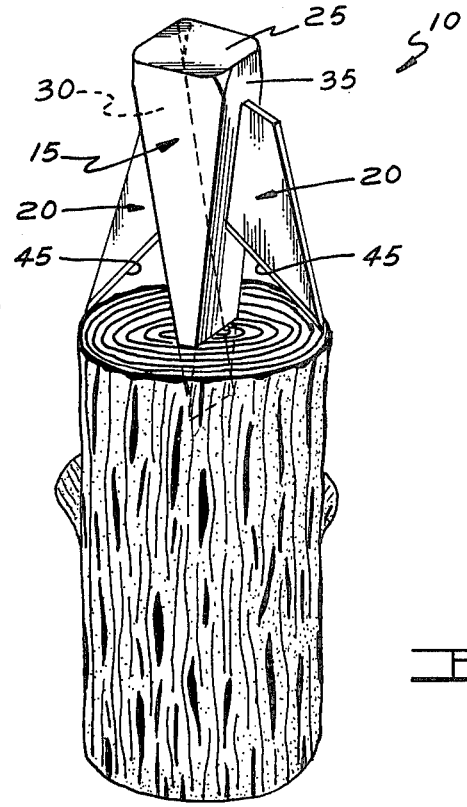
Fig. 1.
Fig. 2.
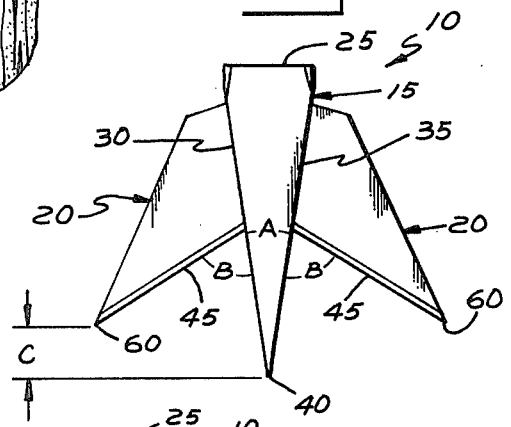
Fig. 3.
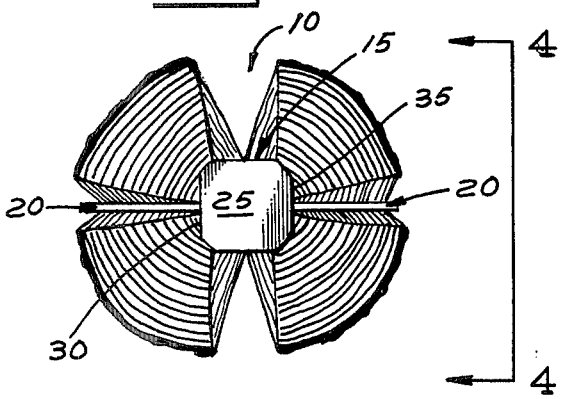
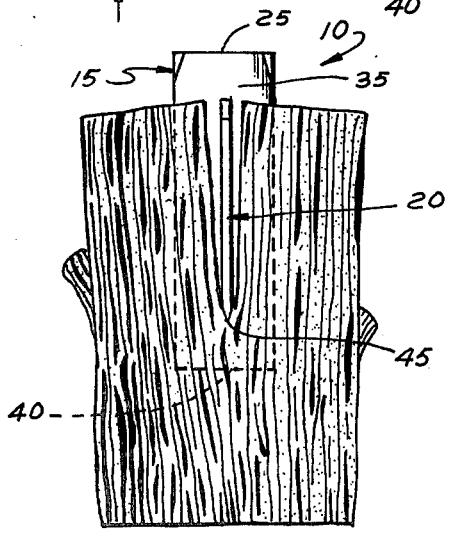
Fig. 4.

LOG QUARTERING WEDGE

This application is a continuation-in-part of my earlier application Ser. No. 805,928, filed June 13, 1977, now abandoned.

BACKGROUND

This invention relates to log splitting wedges and specifically to splitting wedges for quartering logs.

Wedges have long been employed in the logging art for both splitting logs and holding open a saw kerf to prevent the sides of the kerf from pinching a saw. Typically, such wedges include a sharp chisel edge for penetrating the log and a blunt end which receives driving impulses from a suitable means such as a sledge hammer. However, a wedge which effectively quarters logs when driven into an end thereof has heretofore been unknown in the logging art.

Various industrial log splitters such as that disclosed in U.S. Pat. No. 3,974,867 to Butas, Jr. employ pairs of perpendicularly disposed knife blades for quartering logs. However, such pairs of blades are approximately of equal thickness and not suitable for the quartering of logs by use of a sledge hammer as described hereinabove but rather require power means, such as hydraulic rams to drive the logs into the knife blades.

Sometimes, as a logging wedge is being driven into a very resilient log of high lubricity a slightly off center blow by a sledge results in the wedge being dislodged and forcibly propelled through the air with risk of serious injury to the user or others in the vicinity. In an effort to prevent such occurrences, cross wedges such as that disclosed in U.S. Pat. No. 2,286,586 to Starks have been developed. Cross wedges such as that shown in the Starks Patent and in Austrian Patentschrift No. 185,266 comprise a pair of wedges, the sharpened edges of which are disposed at right angles with respect to each other. Although, the cross wedge may obviate the aforementioned occurrences, it will be appreciated that a great deal of force is required to achieve log quartering with such wedges.

Also taught in the prior art is a winged logging wedge disclosed in U.S. Pat. No. 3,515,372 to Courville. The Courville wedge functions to prevent a log being sawed from rolling into a twist. This wedge includes a relatively thick wedge body having a chisel edge and a pair of transverse wings extending slightly forwardly from the wedge body. The wings are of a surface area and geometry unsuitable for log quartering, since among other factors their leading edges lie in a plane parallel to a plane containing the leading edge of the wedge.

Accordingly, it is a principal object of the present invention to provide a log quartering wedge which overcomes the drawbacks of the wedges heretofore available.

It is another object of the present invention to provide a log quartering wedge wherein any tendency for the wedge to be canted or dislodged is minimized as the wedge is being driven into a log.

It is another object of the present invention to provide a log quartering wedge which is essentially incapable of being forced out of a log under the influence of the resilience or the lubricity of the wood.

It is another object of the present invention to provide a log quartering wedge which may be easily used with relative safety by one having little or no special skill in log splitting.

These and other objects will become apparent from the following detailed description with reference to the accompanying drawings in which:

FIG. 1 is a perspective view of the quartering wedge of the present invention having been partially driven into a log;

FIG. 2 is an elevational view of the quartering wedge of the present invention;

FIG. 3 is a top plan view of the quartering wedge being driven into a log a substantial portion of which is shown as having been quartered by the wedge;

FIG. 4 is an elevational view seen in the direction of line 4—4 of FIG. 3;

DESCRIPTION OF THE PREFERRED EMBODIMENT

Figure 5:
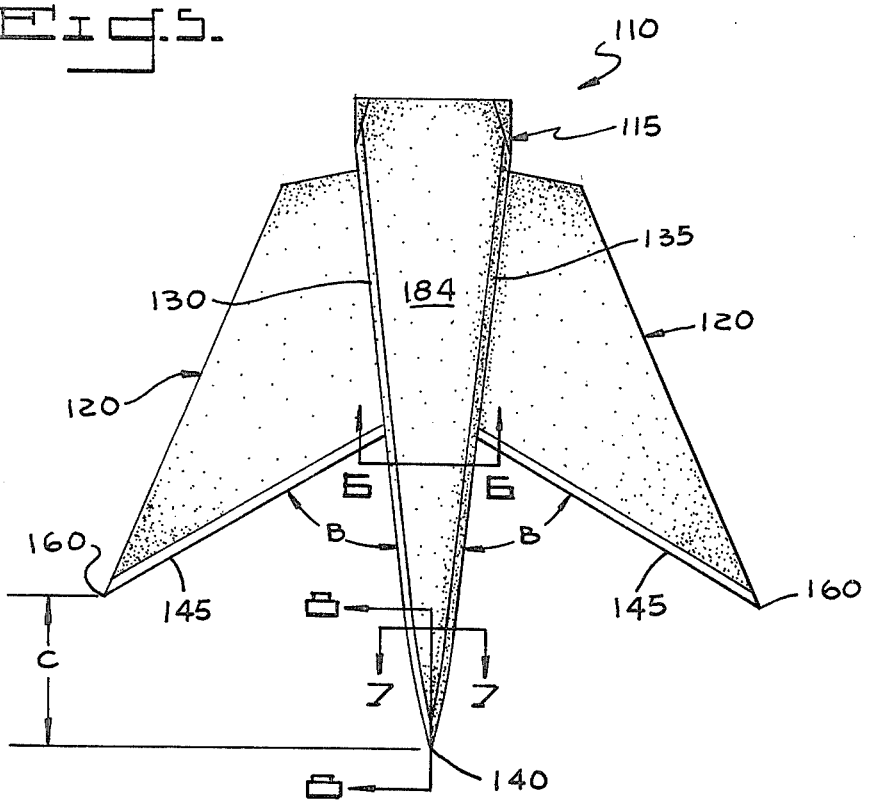
FIG. 5 is an elevational view of an alternate embodiment of the quartering wedge of the present invention.

Referring to the drawings, the log quartering wedge of the present invention is shown generally at 10 and includes a primary splitting wedge 15 and auxiliary quartering blades 20 extending outwardly therefrom which are of generally planar configuration.

Primary splitting wedge 15 is formed from any material of suitable strength and hardness, steel being particularly well suited for this application. Wedge 15 includes a blunt end 25 adapted for receiving blows from any suitable striking implement (not shown), such as a sledge hammer. The wedge also includes a pair of opposed, generally flat, converging lateral surfaces 30 and 35 which meet at a chisel shaped leading edge 40. Primary wedge 15 functions as in ordinary prior art splitting wedges, edge 40 serving to penetrate the log and surfaces 30 and 35 serving as the wedge is driven into the log to split the log into halves as shown in FIG. 3. The angle A, defined by surfaces 30 and 35, may be of any suitable value such as used in conventional log splitting wedges. While surfaces 30 and 35 have been shown as diverging from edge 40 to end 25, it will be understood that portions of these surfaces adjacent end 25 may be formed parallel to one another without departing from the present invention.

Blades 20 extend outwardly from surfaces 30 and 35 and serve to quarter the logs by halving again each of the half log sections split apart by primary wedge 15. As shown, splitting blades 20 are generally trapezoidal in shape and are formed from any suitable material, such as steel, which possesses requisite strength and hardness. The blades are of substantially lesser thickness than wedge 15 measured between surfaces 30 and 35 at any longitudinal location between the juncture of the wedge and blades and blunt end 25. It will, of course, be appreciated that splitting blades embodying the present invention may be triangular in shape, the outer edges being straight from the blade tip to the juncture with wedge 15. Splitting blades 20 may be formed integrally with primary wedge 15 as by forging or other suitable techniques or may be affixed thereto as by welding, brazing or other appropriate methods. Each blade includes a leading edge 45 which defines an acute angle B with one of the adjacent converging surfaces 30 and 35, angle B being on the order of from 15° to 45° (FIG. 2). The leading edge of each blade is preferably sharpened to a double beveled cutting edge. However, it will be understood that the blade leading edges may be sharpened to a single beveled edge without departure from the invention. In using a single beveled cutting edge it may be preferable to have the bevels disposed on opposite sides of the two blades to aid in stabilizing the blades as they are driven through a log.

The entire leading edge of each blade is set back axially a distance C from leading edge 40 of primary wedge 15 and the tip or outermost point 60 of each blade is offset a substantial distance from the leading edge of the wedge, whereby in use there is substantial splitting of the wood by the wedge 15 into two half sections before the points 60 penetrate the upper surface of the log. The set back C may be on the order of about 2 inches.

A wedge embodying the present invention effectively quarters logs with relative ease and may be coated with "Teflon" to reduce frictional drag as the wedge is driven through a log. Preferably, the log is stood on end and maintained in that orientation while the quartering wedge is driven downwardly into the upper end of the log as shown in FIG. 1. In splitting logs with a wedge it will be recognized that most force is required to achieve penetration by the wedge sufficient to initiate splitting of the wood. As the wedge is driven deeper into the log, the lubricity of the wood and the tendency of the log to continue splitting along grain lines renders the work less strenuous once splitting has started. In the present invention, because of the set back of the quartering blades from the leading edge of the wedge, as the wedge is being driven into the log, at first only the primary wedge will penetrate the wood. As the quartering wedge is driven deeper into the log, splitting of the wood will be initiated. At this depth of the primary wedge within the log the force necessary to continue the splitting action is substantially reduced. Since the leading edges of the splitting blades are disposed at an acute angle with converging surfaces 30 and 35 and since the triangular tips 60 of the blades are offset rearwardly from the chisel edge 40, initial penetration of the blades occurs after the primary wedge has commenced splitting the log into halves and the force required for quartering is considerably reduced and confined to the outer triangular tip portions 60. Penetration of the blade tips will not only initiate quartering of the log but will serve to relieve the grip of the splitting log halves on the wedge and thereby aid in the halving as well as the quartering of the log. As the quartering blades are driven deeper into the log, lateral penetration of the blades 20 will increase radially toward the center of the log. Splitting of each half log by blades 20 will commence near the outer circumference of the log and expand radially inward. There is thus a correlative increase in resistance to splitting by blades 20 as the resistance to penetration by the primary wedge decreases.

When the entire length of the leading edge of each blade has penetrated into the log (FIGS. 3 and 4), the wedge will have penetrated the log to a depth at which either the log is halved or work required to complete the splitting is markedly reduced from that required in initiating the splitting. Furthermore, splitting by the quartering blades is initiated near the outer edge of the log which dries out sooner than the interior of the log and is thus easier to split. Therefore, it will be appreciated that logs may be quartered with the wedge of the present invention without a great deal more work than would be required to halve a particular log using a conventional splitting wedge. Moreover, two or more auxiliary blades may be used on each side of the primary wedge where it is desired to split logs into sixths rather than quarters.

In addition, the quartering wedge embodying the present invention minimizes the risk of the misdirection of wedge penetration or dislodgement of the wedge from the log under the influence of the wood resilience and lubricity. As the wedge is driven into the log and the quartering blades penetrate the log, the grain structure of the wood will tend to guide the quartering blades in a direction parallel to the longitudinal axis of the log with the blades 20 serving as stabilizing means whereby the wedge is held and guided in its movement perpendicular to the plane of the upper surface of the log. In this way any tendency of the wedge to be dislodged from the work and hurled through the air is minimized.

Figure 6:
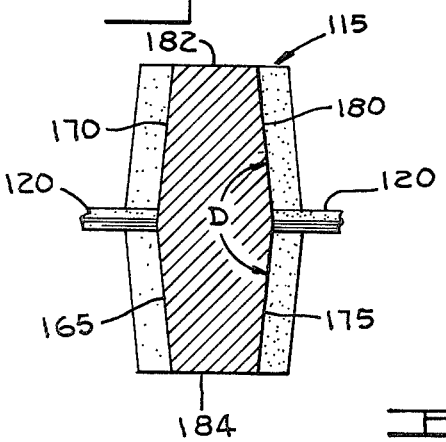
FIG. 6 is a sectional view taken along line 6—6 of FIG. 5.
Figure 7:
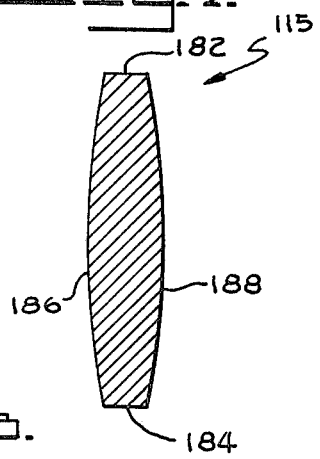
FIG. 7 is a sectional view taken along line 7—7 of FIG. 5.
Figure 8:
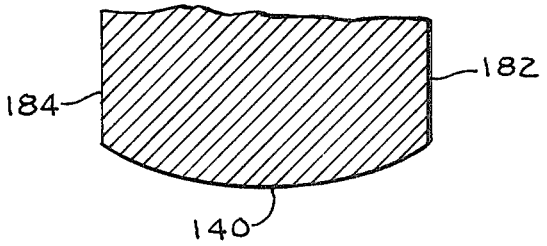
FIG. 8 is a sectional view taken along line 8—8 of FIG. 5.

Referring to FIGS. 5, 6 and 7 an alternate embodiment of the quartering wedge is shown at 110 and includes a contoured wedge 115 and a pair of quartering blades 120. As will be readily appreciated from the drawings, wedge 110 is of the same overall configuration as wedge 10 described above, blades 120, including tip portions 160 being set back from chisel edge 140 of the primary wedge a substantial distance C. The blades include sharpened leading edges 145 with which the converging surfaces 130 and 135 of the wedge 115 define acute angles B which may vary from 15 to 45 degrees. Thus it will be appreciated that wedge 110, just as wedge 10, may be effectively employed to quarter logs and will exhibit little tendency to become dislodged from the log under the influence of the resilience or lubricity of the wood.

The contour wedge 110 differs from the wedge 10 in that its cross sectional configuration is generally hexagonal as shown in FIG. 6, rather than rectangular as is the case with the flat sided wedge shown in FIG. 1. The wedge 110 tapers from the top surface to the cutting edge as shown in FIG. 5 and each of its inclined side surfaces is defined by a pair of angled surfaces 165 and 170 on one side and 175 and 180 on the other side of the wedge. Each pair of angled surfaces intersect along a line which corresponds approximately to the center of the splitting blades 120. The angled surfaces from an obtuse dihedral angle of approximately 140–170 degrees. On one side of the blades 120, the angled surfaces 170 and 180 converge toward the end surface 182 and on the opposite side of the splitting blades, the surfaces 165 and 175 converge toward the opposite end of surface 184.

Adjacent the chisel or cutting edge of the wedge 140, the inclined side surfaces merge into oppositely, convexly curved or arcuate surfaces 186 and 188 (FIG. 7) which terminate along an arcuate chisel edge 140. The convexly curved tip portion of the wedge may extend from sufficiently above the edge 140 to facilitate resharpening of the cutting edge as may be necessary or desirable after extensive use.

The contour wedge 110 has been found remarkably effective in splitting logs of all sizes and varieties. Not only is this contoured quartering wedge more effective than any wedge heretofore available, but its configuration also facilitates casting of the wedge as an integral structure wherein the tapered or angled side surfaces of the wedge serve as drafts enabling easy removal of the wedge from the mold cavities after casting.

While there has been shown and described two embodiments of the quartering wedge of the present invention, it will be understood that modifications may be made without departing from the invention, and it is intended by the appended claims to cover such modifications as come within the true spirit and scope of this invention.

Having thus disclosed the invention, what is claimed is:

1. Log quartering wedge comprising a pair of tapered side surfaces meeting at the leading edge of the wedge and a pair of quartering blades extending outwardly of said side surfaces in a common plane generally normal to said side surfaces, each of said side surfaces comprising a pair of obliquely angled surfaces meeting generally at an obtuse dihedral angle in said common plane such that the cross sectional configuration of said wedge between said side surfaces in a plane normal to said common plane, has its greatest thickness generally at said common plane, each of said quartering blades including a leading edge disposed at an acute angle relative to the adjacent side surface, said cross sectional thickness of the wedge being substantially greater than the thickness of said quartering blades.

2. Log quartering wedge of claim 1 wherein the leading edge of each quartering blade is set back at a substantial distance from the leading edge of said wedge.

3. Log quartering wedge of claim 2 wherein each quartering blade has a generally straight leading edge and a triangular outer tip portion.

4. Log quartering wedge of claim 3 in which the leading edge of said blade has a beveled cutting edge.

5. Log quartering wedge of claim 1 wherein said leading edge of said wedge comprises the convergence of said tapered surfaces along a cutting edge, said tapered surfaces being of convex curvature in cross section adjacent said cutting edge, said angled surfaces of the wedge merging smoothly into the convexly curved surfaces.

6. Log quartering wedge of claim 5 wherein the leading edges of said blades are provided with double beveled cutting edges.

* * * * *